US006123135A

United States Patent [19]

Mathews

[11] Patent Number: 6,123,135

[45] Date of Patent: Sep. 26, 2000

[54] WINDOW-SCREEN COMBINATION AND METHOD OF USE

[75] Inventor: Joseph J. Mathews, Goleta, Calif.

[73] Assignee: Architectural Millwork of Santa Barbara, Inc., Santa Barbara, Calif.

[21] Appl. No.: 09/260,917

[22] Filed: Mar. 2, 1999

[51] Int. Cl.[7] ..... A47H 1/00

[52] U.S. Cl. ..... 160/26; 160/31; 160/24; 292/252; 292/DIG. 35

[58] Field of Search ..... 160/24, 26, 23.1, 160/31, 127, 265, 270, 290.1, 272, 277.1, 268.1, 269; 292/23, 42, 252, DIG. 35

[56] References Cited

U.S. PATENT DOCUMENTS

| | | | |
|---|---|---|---|
| 263,276 | 8/1882 | Wood | 292/252 |
| 753,544 | 3/1904 | Cassidy | 292/252 |
| 1,233,658 | 7/1917 | Forner . | |
| 1,260,641 | 3/1918 | Cavagiieri . | |
| 1,355,608 | 10/1920 | Knapp . | |
| 1,536,005 | 4/1925 | Housteau . | |
| 1,684,134 | 9/1928 | Mesurier | 292/DIG. 35 X |
| 1,823,514 | 9/1931 | Shrauger . | |
| 1,840,454 | 1/1932 | Kennedy | 160/269 X |
| 1,922,286 | 8/1933 | Gronbech . | |
| 2,054,003 | 9/1936 | Rissmann | 160/31 |
| 2,220,756 | 11/1940 | Egli . | |
| 3,158,195 | 11/1964 | Ney . | |
| 3,219,374 | 11/1965 | Snell | 292/252 |
| 3,764,172 | 10/1973 | Standke | 292/252 X |
| 4,359,079 | 11/1982 | Bledsoe | 160/26 |
| 4,369,829 | 1/1983 | Casiday | 160/26 X |
| 4,531,562 | 7/1985 | Swanson | 160/26 |
| 4,649,980 | 3/1987 | Kunz | 160/26 X |
| 4,781,235 | 11/1988 | Hedstrom et al. | 160/26 X |
| 5,092,388 | 3/1992 | Evers . | |
| 5,671,790 | 9/1997 | Andersen et al. | 160/31 X |

*Primary Examiner*—Bruce A. Lev
*Attorney, Agent, or Firm*—Leo F. Costello

[57] ABSTRACT

A window-screen combination wherein the screen is concealed when not in use but is readily accessible for servicing or replacement. The window-screen assembly includes a window frame circumscribing a window opening and including a peripheral outer frame portion providing an elongated header recess facing into the opening. The frame also includes a plurality of elongated inner frame members separable from the outer frame portion and disposed along the periphery of the opening. A first of the frame members, a header member, is positioned over the recess so that a passageway remains between the recess and the opening. The other of the frame members, jamb members, extend downwardly from the header member and form opposed vertical guideways adjacent to the window opening and aligned with the passageway. The header member is releasably attached to the outer frame portion, and quick-connect fasteners are located between the outer frame portion and the jamb members and releasably interconnect the jamb members to the outer frame portion; and a screen unit is removably received in the recess and is retained therein by the header member. The screen unit includes a screen aligned with the passageway and is movable through the passageway and within the guideways into screening positions in the window opening and a retracted position out of the opening.

20 Claims, 10 Drawing Sheets

WINDOW-SCREEN COMBINATION AND METHOD OF USE

BACKGROUND

In a casement window built for use in the United States, customers prefer that the window swing outwardly of the building, as contrasted with the British preference for an inward swinging casement window. This preference aggravates the problems of using a window screen with a casement window. A solution to these problems is addressed by the present invention.

When it is desired to use a window that can be opened, incorporating a screen usually is a consideration but always presents a problem irrespective of the type of window used. Most commonly, whether the window is casement, double or single hung, sliding, jalousie, or other type that can be opened, the screen is typically fixed and always in the line of sight even though it is obviously more of an obstruction than the glass of the window.

The use of a screen in an American-style casement window presents an additional problem. The screen must be placed on the inside of the window or else it will interfere with the outward swinging of the sash. The appearance of the window from the inside is thus dominated by the screen and detracts from the window design. The presence of the screen may be even more annoying when the window is made of wood, since the metal of the screen and its austere construction may be considered to detract from the natural beauty of the wood.

Attempts have been made to solve these problems by providing retractable screens. The known commercial type of retractable screen is contained in a housing that is mounted within the window frame under the header. Although the screen is concealed in the housing, the entire metal screen unit is still visible at the top of the window, covering a small part of the viewing area, but still detracting from window design itself, especially if the window is made of wood. Yet, there is an advantage of this exposed mounting since it is readily accessible for servicing of the screen unit.

It is also known to conceal screen units within a window frame so that the screen itself can be moved over the window opening or retracted out of the window opening. Such a concealed screen is disclosed in the U.S. Pat. No. 1,260,641 to Cavaglieri. Although this construction conceals the screen and its roller, the guide tracks for the screen and mounting brackets used with the installation are still exposed, thereby detracting from the appearance of the window, whether of metal or wood. These mounting brackets enable access to the screen recess for limited servicing of the unit, but only the screen itself can be removed and replaced. The screen roller and other mechanism cannot be removed or accessed without ripping out the window or parts thereof, a task that would discourage use of this patented structure.

SUMMARY

A window-screen combination is provided wherein the screen is concealed when not in use but is readily accessible for servicing -or replacement. In the disclosed embodiment, the window-screen assembly includes a window frame circumscribing a window opening and including a peripheral outer frame portion providing an elongated header recess facing into the opening. The frame also includes a plurality of elongated inner frame members separable from the outer frame portion and disposed along the periphery of the opening. A first of the frame members, a header member, is positioned over the recess so that a passageway remains between the recess and the opening. The other of the frame members, jamb members, extend downwardly from the header member and form opposed vertical guideways adjacent to the window opening and aligned with the passageway. The header member is releasably attached to the outer frame portion, and quick-connect fasteners are located between the outer frame portion and the jamb members and releasably interconnect the jamb members to the outer frame portion; and a screen unit is removably received in the recess and is retained therein by the header member. The screen unit includes a screen aligned with the passageway and is movable through the passageway and within the guideways into screening positions in the window opening and a retracted position out of the opening.

An object of this invention is provide a window-screen combination and method of use in which a screen is concealed when not in use and yet is readily accessible for servicing or replacement.

Another object is to enable parts of a window frame to be readily installed or removed in order to obtain access to a concealed window screen.

An additional object is to provide a removable screen and window parts wherein the parts conceal the screen when the screen and parts are assembled in a window frame.

A further object is to maximize the view through a window that uses a screen by entirely concealing the screen and its installation hardware when the screen is not in use.

An additional object is provide an improved screen installation that is usable in various types of windows including casement, double or single hung, sliding, jalousie, or other type.

Another object is provide an improved screen installation for a casement window that opens outwardly.

Yet another object, in a window primarily made of wood, is to conceal the metal parts of a window screen unit and its associated hardware in order to retain the appearance of the window as a wooden window.

A still further object is to provide a method for easily installing and removing a screen unit and associated hardware along with removable parts of a window frame in a window-screen combination without having to rip out fixed parts of the window frame and while the fixed parts of the window frame and window remain in place.

These and other objects, features and advantages of the present invention will become apparent upon reference to the following description, accompanying drawings, and appended claims.

DETAILED DESCRIPTION OF THE WINDOW-SCREEN COMBINATION

Figure 1:
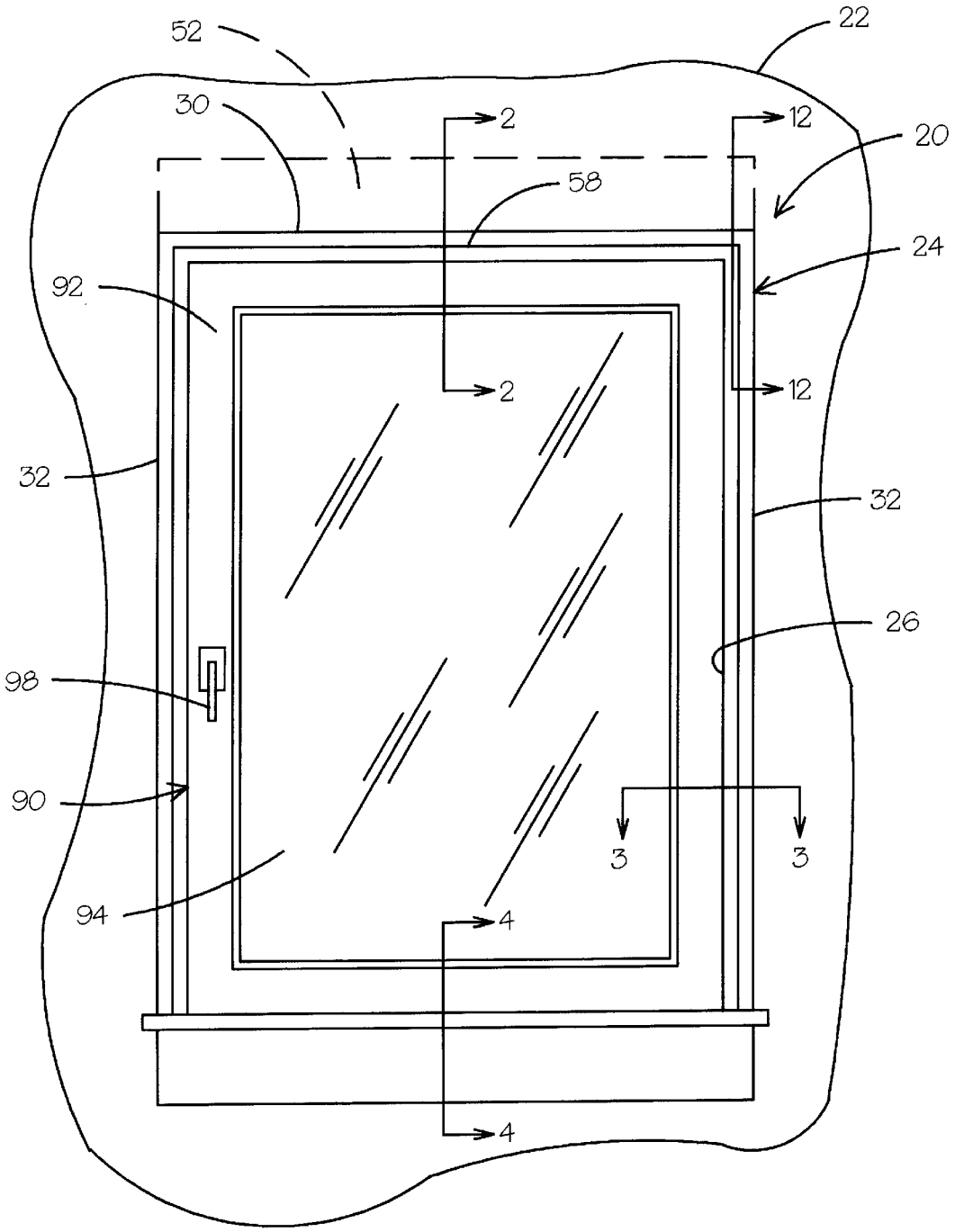
FIG. 1 is an inside front elevation of a window-screen combination in a wall, fragmentarily shown, with the screen box shown in dashed outline and with the screen not visible since it is in its fully retracted position, all in accordance with the present invention.
Figure 6:
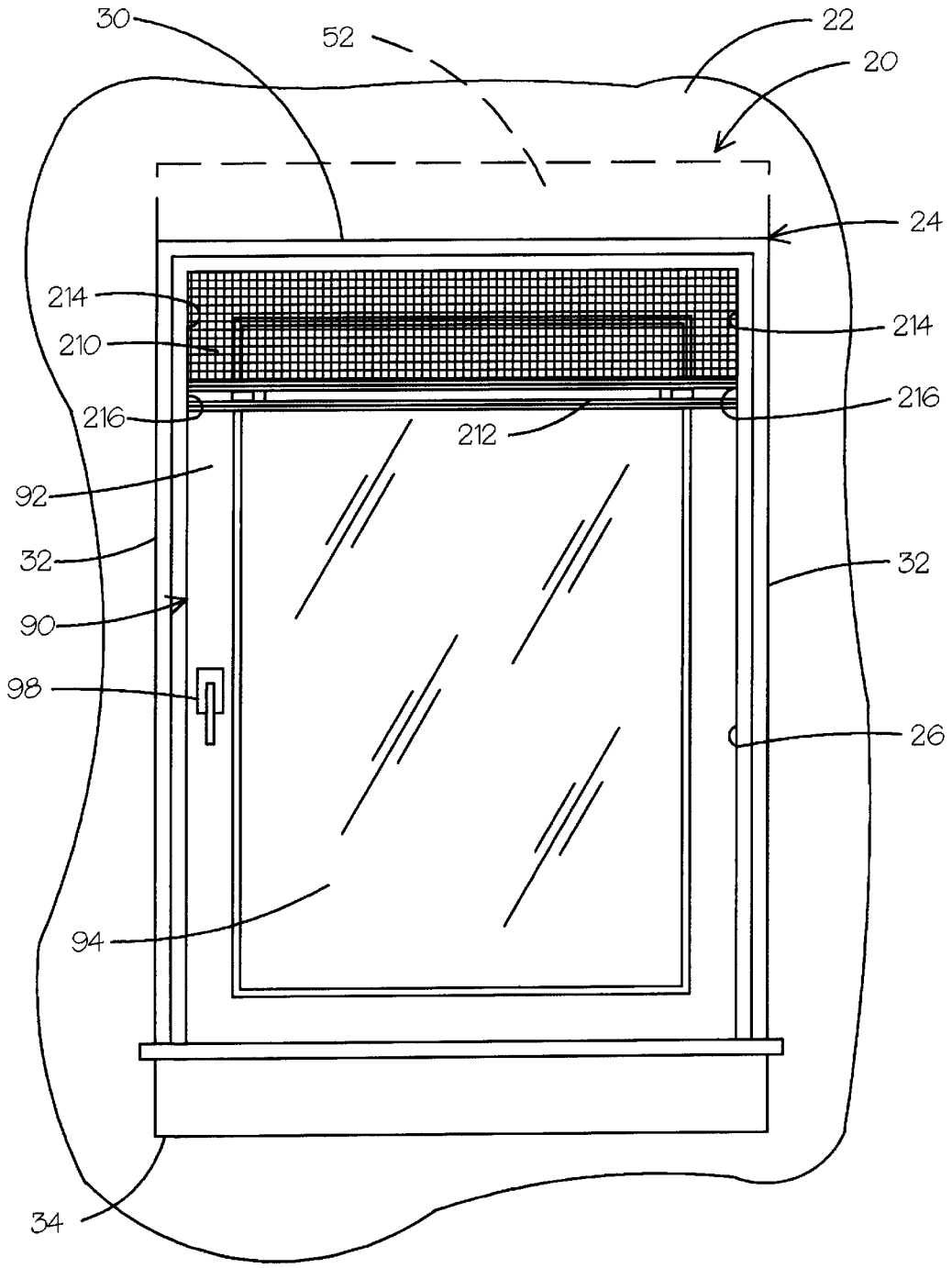
FIG. 6 is a view similar to FIG. 1 but showing the screen partially extended over the window of the subject window-screen combination.
Figure 7:
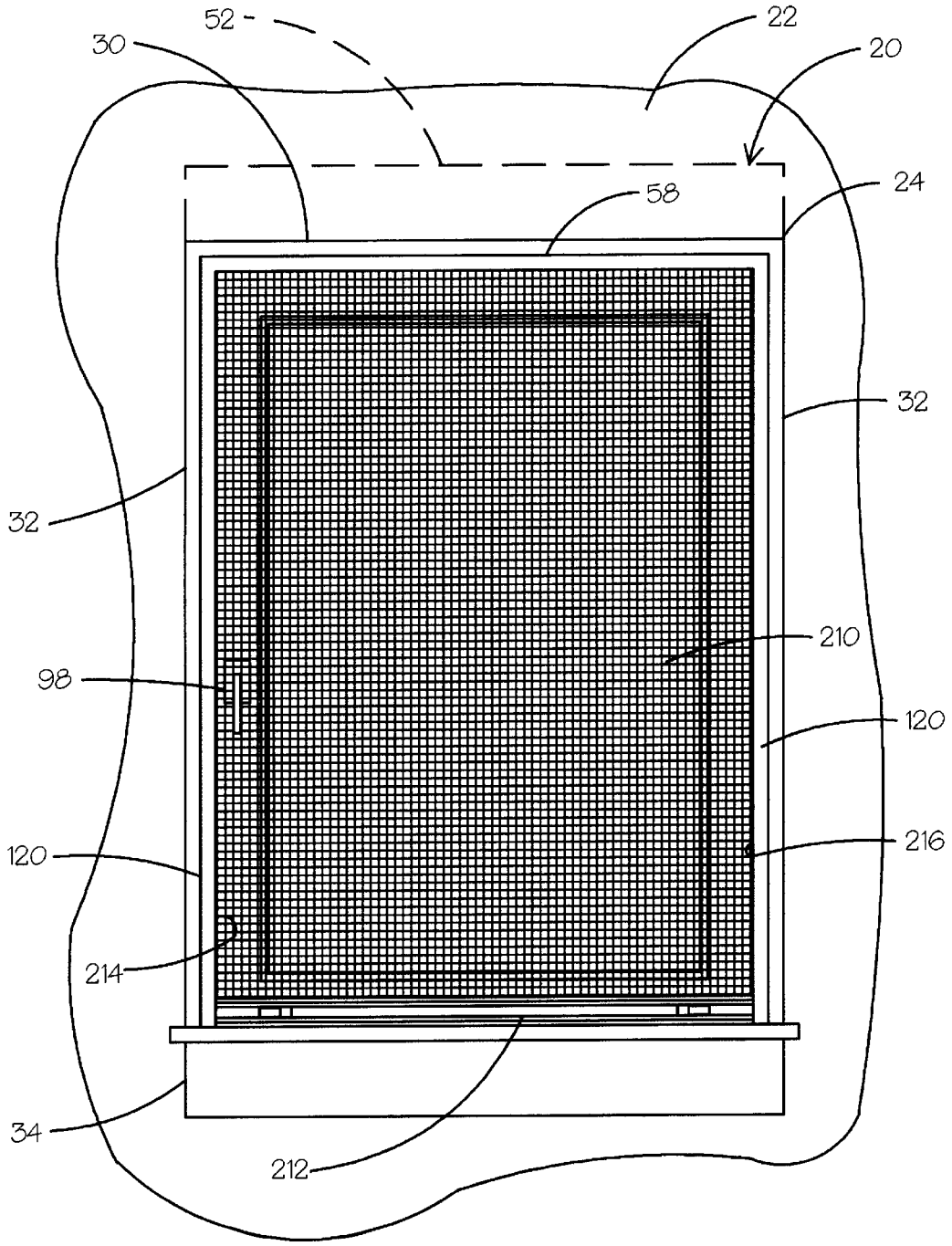
FIG. 7 is also a view similar to FIG. 1 but showing the screen in its full screening position over the window.

A window-screen combination incorporating the principles of the present invention is identified by the numeral 20 in FIGS. 1, 6 and 7. The window-screen combination is shown installed in a building wall 22, only a fragment of which is illustrated in the various views. The window-screen combination includes a window frame 24 (FIGS. 1–3, 10 and 12), preferably made of wood, circumscribing a window opening 26 and including a peripheral outer frame portion 28. The outer frame portion has a header section 30, a jamb section 32, and a sill section 34.

The header section 30 (FIGS. 1, 2, 10 and 12) includes a horizontal, outside header piece 40, an intermediate header piece 42, and an inverted, U-shaped header box 44, each of which is permanently fastened in place in the building wall 22 in the conventional way of installing a window. The header box includes a vertical outside panel 46, a horizontal top panel 48, a vertical inside panel 50 having a height or width slightly greater than the outside panel, thereby providing a pendant portion 51 projecting downwardly toward the window opening 26, and a rectangular recess 52 defined by the panels and communicating downwardly with the window opening 26. A horizontal valance 58 is fastened to the lower portion of the inside panel 50 by screws 60 and has a lower edge 62.

Figure 3:
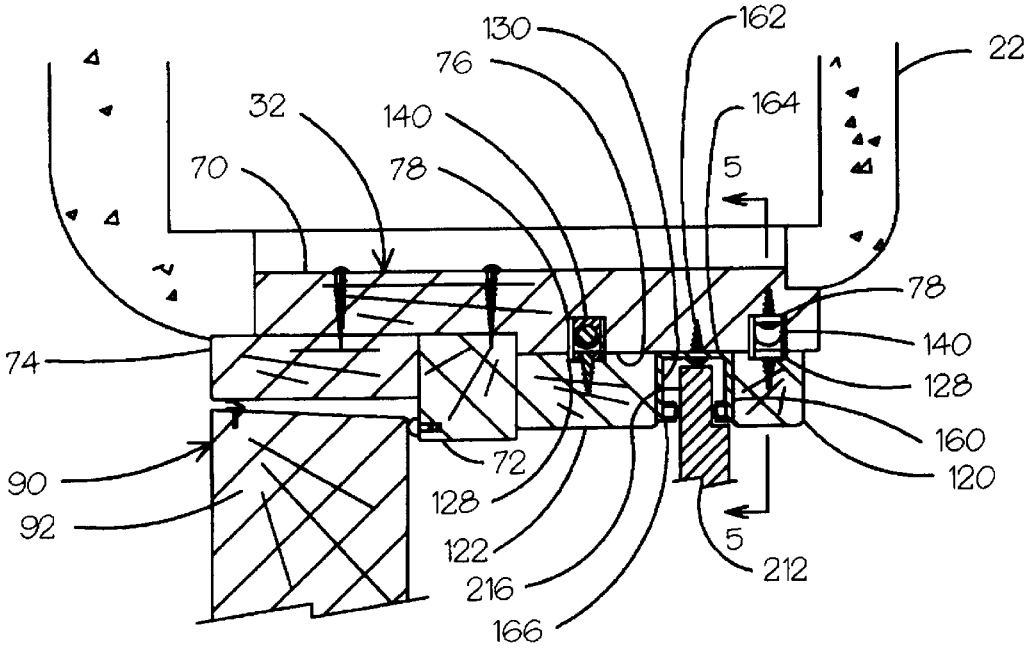
FIG. 3 is an enlarged, fragmentary, horizontal section taken on line 3—3 in FIG. 1.

The jamb section 32 (FIGS. 1, 3, 10 and 12) includes fixed vertical, outer jamb pieces 70 which are best seen in FIG. 3, each of which is notched to received a fixed intermediate jamb piece 72 and a fixed outside jamb piece 74. The terms "outer" and "inner," as used herein, describe the position of a part relative to another part in the plane of the window frame 24, whereas the terms "inside" and "outside" describe the position of part in a plane perpendicular to the plane of the window. Also, the expressions "fixed" or "permanently fastened" are used in a relative sense to distinguish from "removable" as used subsequently herein, meaning that parts that are fixed or permanently fastened are nailed or otherwise fastened in place by conventional building techniques wherein the parts are not intended to be removed unless they are torn or ripped out and thereby destroyed for reconstruction or remodeling or the like of the part of the building concerned. In contrast, the term "removable" as used herein, means that a part although securely fastened in place when assembled, is intended to be and can be readily removed in accordance with the principles of the present invention.

The outer jamb pieces 70 (FIGS. 1, 3, 10 and 12) have inside jamb surfaces 76 extending inwardly of the intermediate jamb piece 72, and each of these surfaces has a pair of transversely spaced, elongated, vertical inside and outside slots 78 extending the full length of the outer jamb pieces. The outer, intermediate, and outside jamb pieces 70, 72 and 74 thus extend the full height or length of the window opening 26 between the header section 30 and the sill section 34 and are in horizontally opposed relation to each other across the window opening. More specifically, the inside and outside slots are respectively in opposed relation to each other across the window opening, with the outside gslots being coplanar and the inside slots being coplanar. It is also to be noted that the intermediate jamb pieces 72 project into the window opening 26 slightly more than the inside jamb surfaces 76 and also more than the inner surfaces of the outside jamb pieces 74. These outer, intermediate and outside jamb pieces are fixed in the window frame 24.

Figure 4:
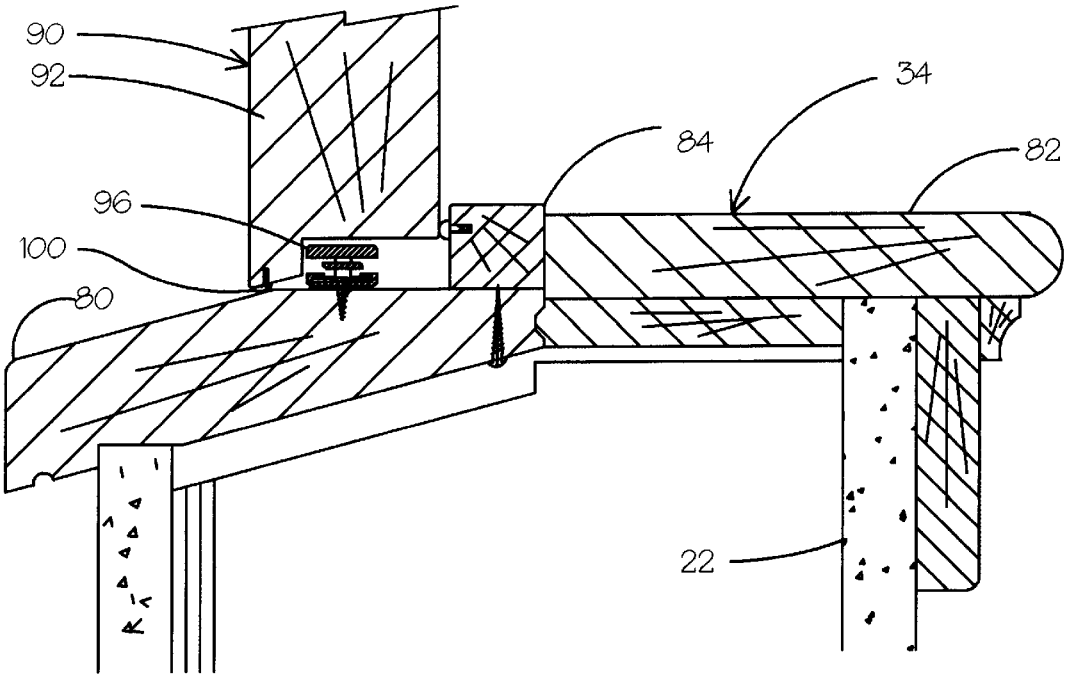
FIG. 4 is an enlarged, fragmentary, vertical section taken on line 4—4 in FIG. 1.

The sill section 34 (FIGS. 1, 4 and 10) of the window frame 24 includes horizontal outside, inside, and intermediate sill pieces 80, 82 and 84 extending between the outer jamb pieces 70 and respectively aligned with the outside jamb pieces 74, the inside jamb surfaces 76 and the intermediate jamb pieces 72. All of these sill pieces are permanently fastened in the window frame 24.

The window-screen combination 20 include a casement window 90 (FIGS. 1–4, 6, 7 and 12) that has a sash 92 and a glass pane 94. The window is mounted in the window frame 24 by upper and lower hinges 96 that are typical of those used in a casement window. These hinges mount the window for pivoting movement about a vertical axis so that the window will swing horizontally between open and closed positions. A handle 98 is attached to the sash, as shown in FIGS. 1, 6 and 7, by which the window may be moved between its closed position, as shown in FIGS. 1, 6 and 7, and open positions, not shown. The handle 98 actuates a latch, not shown but well known, to maintain closure of the window. As previously described, the views in FIGS. 1, 6 and 7 are looking at the window-screen combination 20 from inside the building in which the window-screen combination is incorporated. In opening, therefore, the window swing into the drawing sheet, or away from the viewer, about its vertical axis on the right side of FIG. 1. Thus, the window described and shown is a casement window as typically used in the United States where the window opens outwardly of the building. Weather-stripping 100 is also provided as is the common practice.

The window frame 24 (FIGS. 2, 8, 9 and 12) also includes a removable, elongated, horizontal header member 110 having a generally square or rectangular cross-section and opposite ends 112. The header member has a length approximately equal to the distance between the opposed inside jamb surfaces 76, a width or height (vertical cross sectional dimension) approximately equal to but slightly less than the width or height of the intermediate header piece 42, and a depth (horizontal cross sectional dimension) approximately ⅔ of the depth of the recess 52 in the header box 44.

Figure 2:
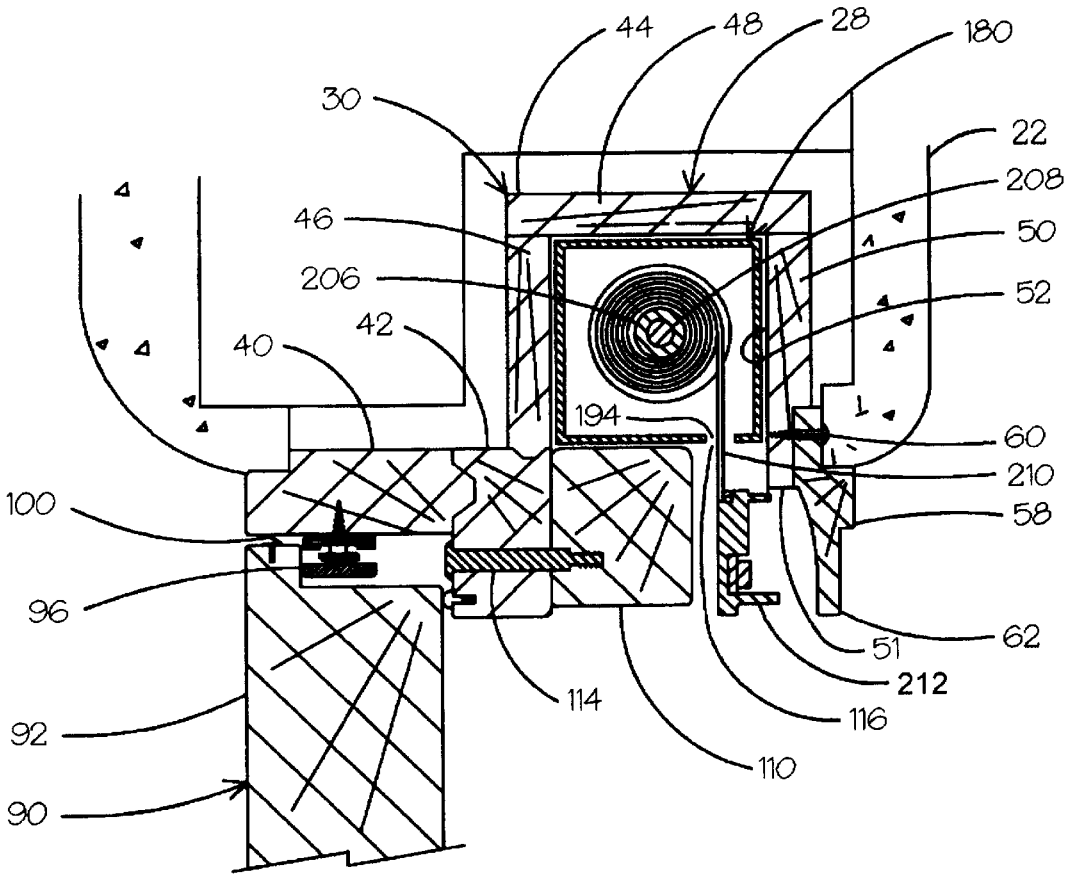
FIG. 2 is an enlarged, fragmentary, vertical section taken on line 2—2 in FIG. 1.

In the assembly of the header member 110 (FIGS. 2, 8, 9 and 12) into the window frame 24, the outside vertical surface of the header member is placed flush against the inside vertical surface of the intermediate header piece 42 and is removably fastened thereto by screws 114, as best seen in FIG. 2. Thus, the header member extends between the inside jamb surfaces 76 of the outer jamb pieces 70 and, because of the dimensional relationships just described, the inside vertical face of the header member is in opposed spaced relation to the valance 58 and to the pendent portion 51 of the inside panel 50 of the header box 44. The header member thus defines a gap or passageway 116 with the pendent portion of the inside panel thereby maintaining the communication between the recess 52 and the window opening 26. It is also to be noted that the lower edge 62 of the valance extends slightly below the lower horizontal face of the header member, again as best seen in FIG. 2.

In addition, the window frame 24 (FIGS. 3, 8, 9 and 12) includes left and right sets or pairs of removable elongated inside and outside elongated vertical jamb members 120 and 122. The left set of jamb members is fully shown in FIGS. 8–11, and a section through the right set is shown in FIGS. 3 and 12. Each of these jamb members is of a generally rectangular or square cross-section, with the outside jamb member of each set being of slightly larger cross-sectional area than the inside jamb member; this dimensional difference is not essential to the principles of the present invention but is merely the preferred relationship in the disclosed embodiment. Each jamb member has an upper end 124 and a lower end 126, with the length of each jamb members being generally related to the distance between the header and sill sections 30 and 34. More specifically, the outside jamb member 122 has a length or height approximately equal to the distance between the inside sill piece 82 and the lower face of the header member 110, when the latter is attached in its position under the recess 52 of the header box 44. The inside jamb member of each set has a length or height approximately equal to the distance between the inside sill piece and the lower edge of the pendent portion 51 of the inside panel 50 of the header box 44. Moreover, the upper portion of the inside jamb members is shaped to mate with the valance 58, as shown in FIG. 12. The inside and outside jamb members have elongated, vertical outer slots 128, 129, respectively, extending between their upper and lower ends and intended to match the corresponding slots 78 in the outer jamb pieces 70 when the removable jamb members are installed in the window frame 24, as subsequently described.

Figure 10:
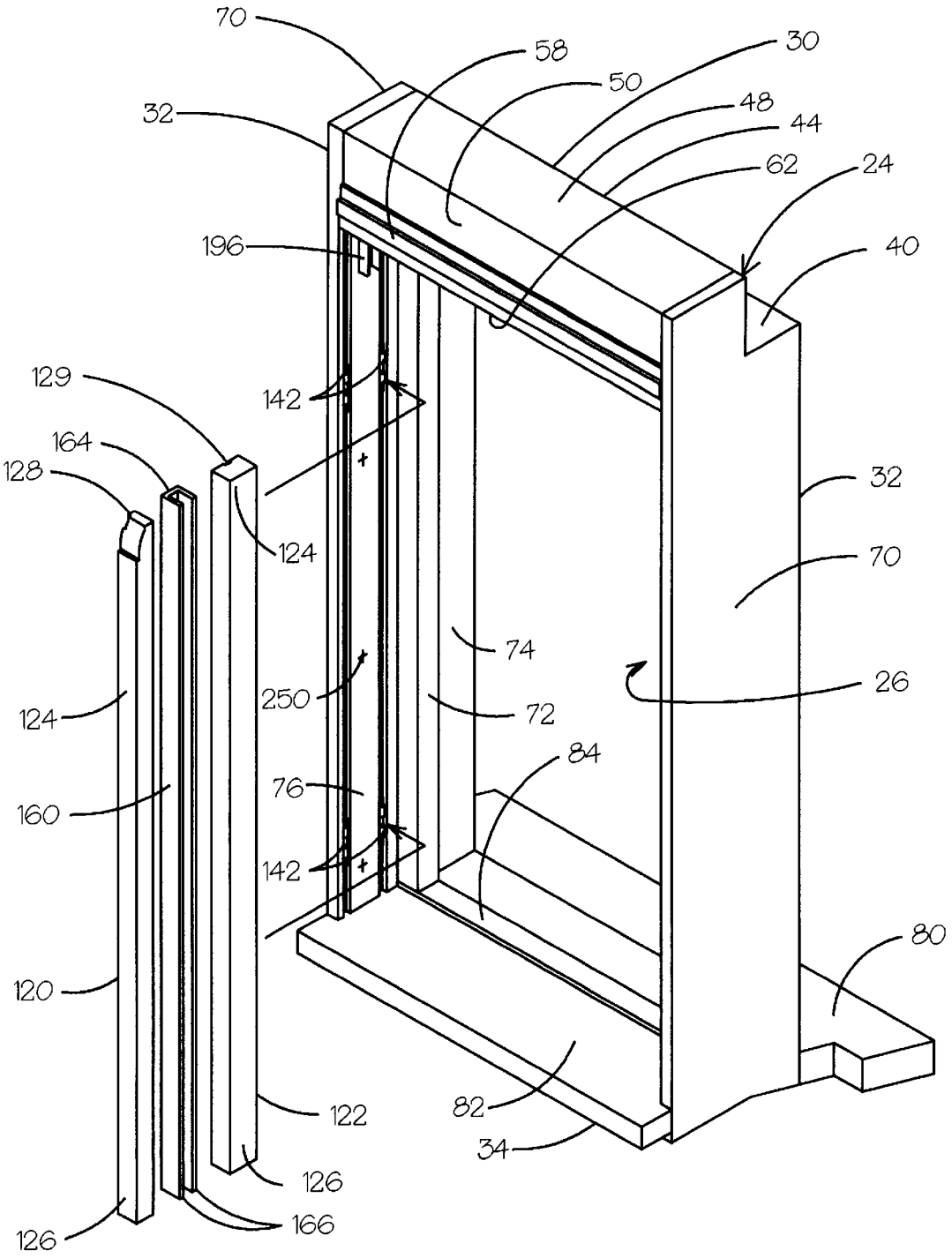

With particular reference to FIGS. 3 and 10, the inside and outside jamb members 120 and 122 are assembled into the window frame 24 in the following manner. The respective left and right sets of jamb members are placed against the opposed inside jamb surfaces 76 so that the slots 128 in the jamb members are in overlying alignment with the slots 78 thereby leaving an elongated vertical guideway 130 between each set of jamb members. Each outside jamb member 122 abuts flush against the inside face of its respectively adjacent intermediate jamb piece 72; the inner surfaces of the jamb members of each set are generally coplanar; and the inside face of each outside jamb member is spaced slightly outwardly of the inside face of its adjacent intermediate jamb piece 72. As will be understood, the guideways 130 defined by the spaced, removable jamb members are opposed to each other and are in a common vertical plane across the window opening.

Figure 5:
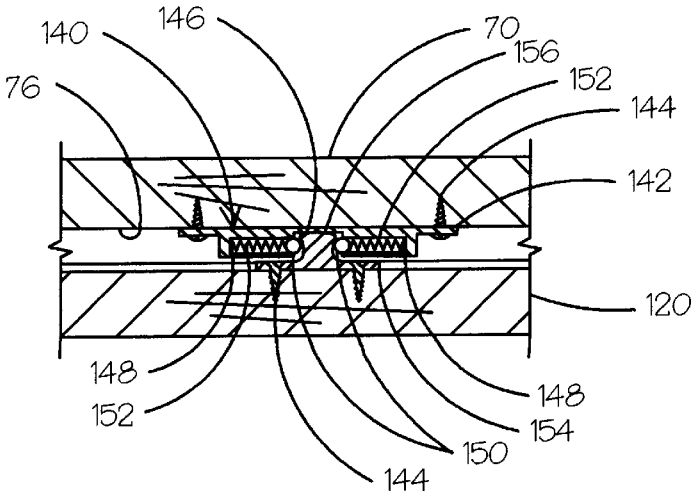
FIG. 5 is a fragmentary, vertical section taken along a plane indicated by line 5—5 in FIG. 3 and showing a detail of the quick-connect fastener used in the present invention.
Figure 8:
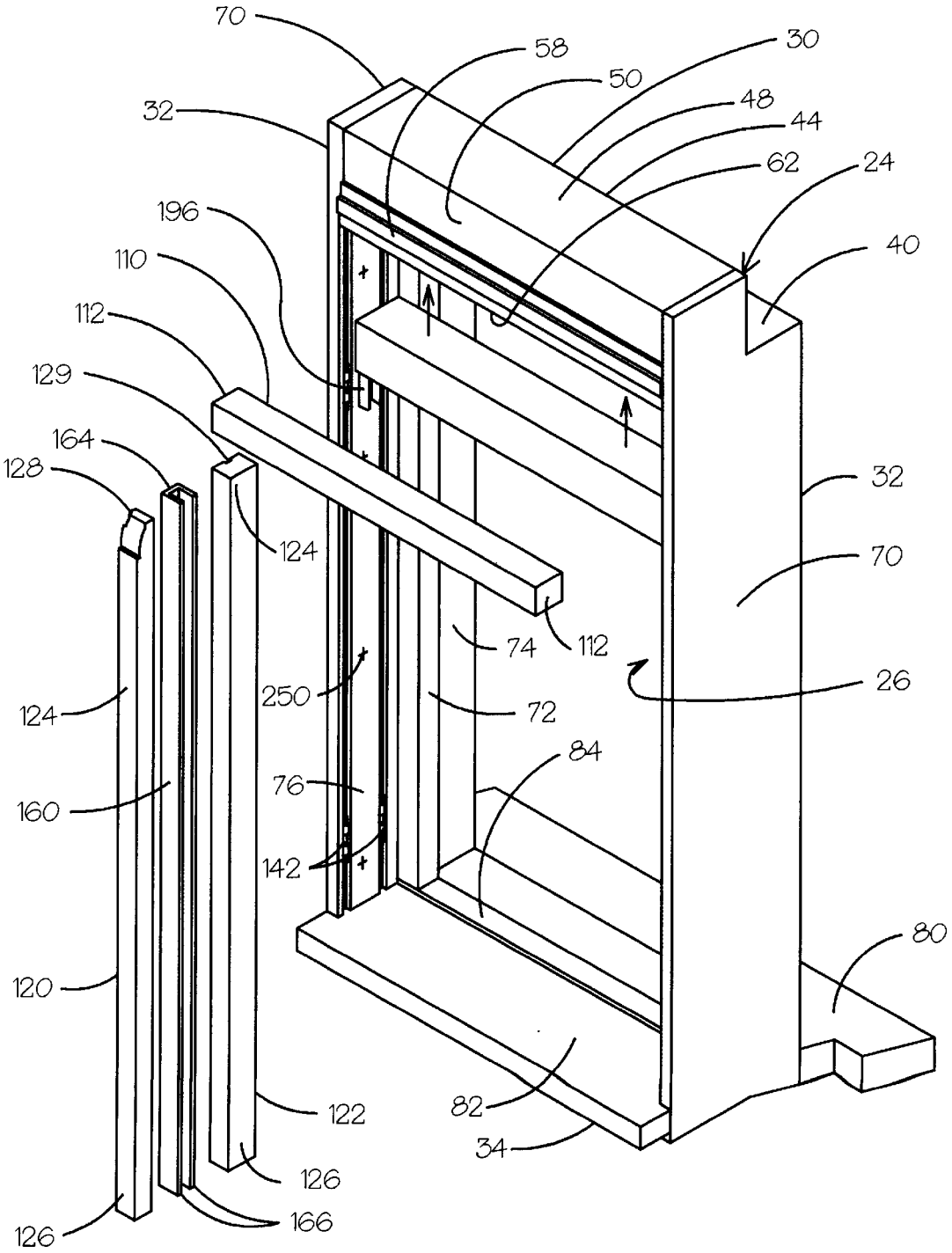
FIGS. 8, 9, 10 and 11 are isometric views of the window frame of the subject invention showing the sequence of steps involved in assembling the screen unit and window frame and, by a reversal of the sequence, showing the steps of disassembly of these parts.

The jamb members 120 and 122 are releasably fastened to the outer jamb pieces 70 by quick-connect fasteners 140 (FIGS. 3, 5 and 8). Preferably a pair of these fasteners is used to connect each jamb member 120 and 122 to its respective outer jamb piece 70. Each such fastener includes an outside bracket 142 (FIG. 5) secured to its outer jamb piece in the slot 78 of the piece by screws 144. This outside bracket has a centrally located female socket 146 and a pair of opposed vertical bores 148, the axes of the bores being perpendicular to the axis of the socket, each bore opening into the socket. Latching balls 150 are received in the bores, and coil springs 152 urge the balls partially into the socket but yieldably allow the balls to be retracted into their bores. Each quick-connect fastener also includes an inside bracket 154 secured to the respective jamb members 120 and 122 by screws 144 and has a male boss 156 extending outwardly from the jamb member. The inside and outside brackets are located so that when the removable jamb members are positioned against the fixed outer jamb pieces, the male bosses align with corresponding female sockets and can be pressed into the sockets against the yielding latching balls. In this manner, the removable jamb members are releasably retained in their assembled positions within the window frame 24. It is thus understood that the jamb members are quickly attached to or removed from the window frame by the quick-connect fasteners. Although these fasteners are referred to as "quick-connect," it will be understood they are also quick-release fasteners, the reference being only to "quick-connect" fasteners for descriptive convenience.

Figure 12:
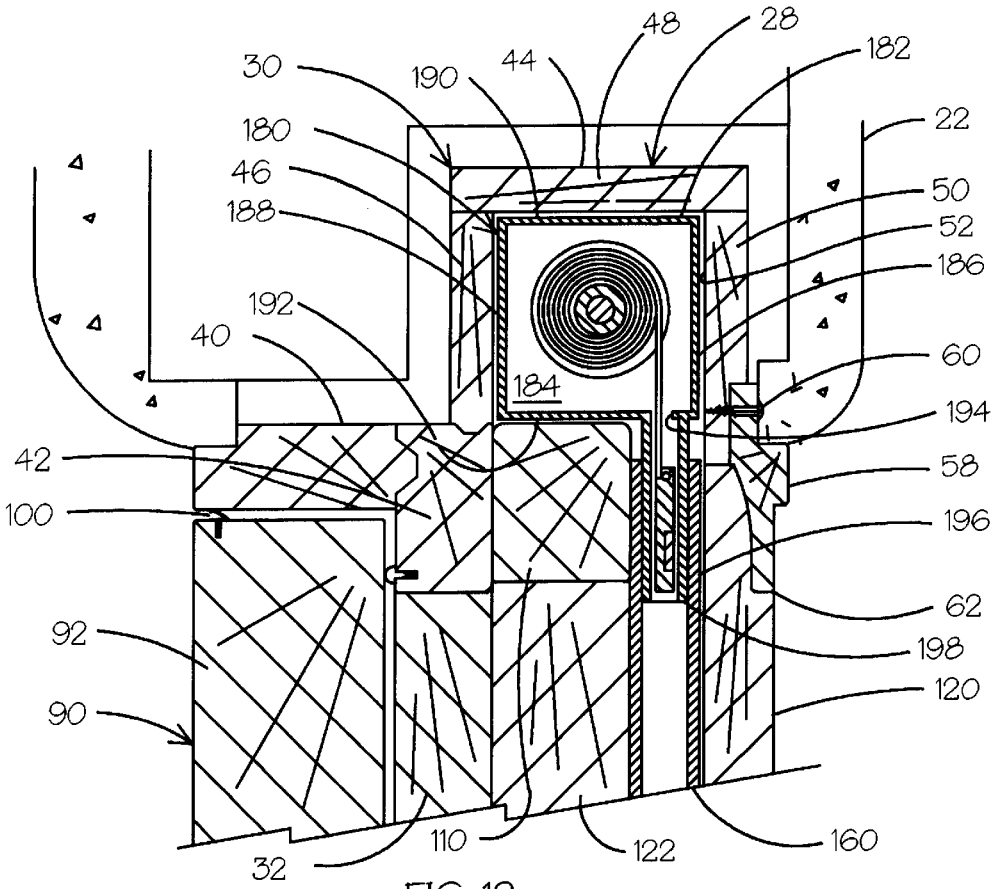
FIG. 12 is an enlarged, fragmentary, vertical section taken on line 12—12 in FIG. 1.
Figure 13:
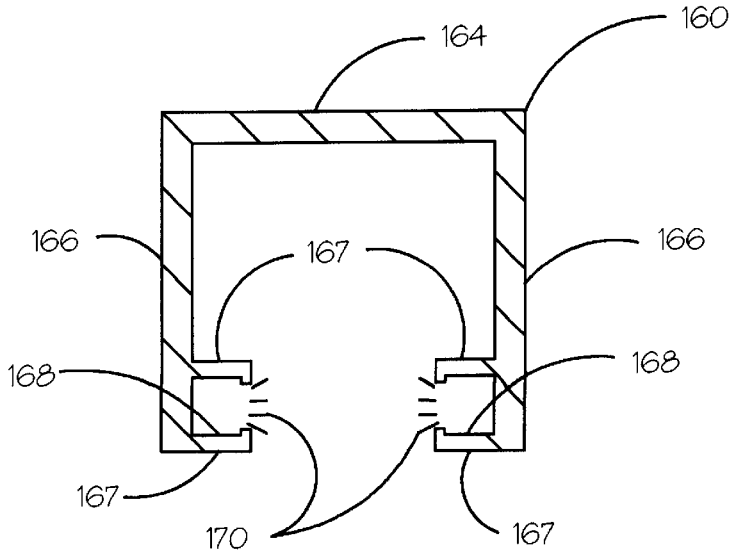
FIG. 13 is an enlarged, transverse section of one of the main tracks used in the subject window-screen combination.

As previously described, when the removable inside and outside jamb members 120 and 122 are fastened within the window frame 24 as above described, they provide the opposed vertical guideways 130 (FIGS. 3 and 12). Elongated channel-shaped, main tracks 160 (FIGS. 3, 10, 12 and 13), preferably made of aluminum, although other materials could be used, are individually removably positioned within the guideways and fastened to their respective outer jamb pieces 70 by screws 162. Each track includes a web 164 against the inner surface 76 of its respective outer jamb piece 70 and a pair of inwardly projecting flanges 166 against the adjacent faces of their respective inside and outside jamb members 120 and 122. The distance between the flanges is thus approximately equal to the width of the guideway, that is, the space between the pair of jamb members in their assembled positions. The width of the flanges is approximately equal to the width of the jamb members so that the inner edges of the flanges terminate in approximately the same common plane as the inner faces of the jamb members, as best seen in FIG. 3. Each track has a length or height approximately equal to the distance between the inside sill piece 82 and the header box 44. More specifically, each track has a lower end that engages the inside sill piece 82 and an upper end that terminates just below the upper face of the header member 110 (FIG. 12), i.e., below the recess 52, when the header member and tracks are in assembled relationship as shown in this figure. The tracks also have transverse mini-flanges 167 providing opposed elongated cavities 168 that open inwardly of the tracks from the outer edges of the flanges 166. Brushes 170 of weatherstriping material are secured in these cavities and project inwardly of the mini-flanges, as shown in FIG. 13.

The window-screen combination 20 (FIGS. 2, 6–8 and 12) also includes a screen unit 180 removably received in the recess 52 of the header box 44. The screen unit includes an elongated housing 182 having a generally square cross-section typically made of metal. The housing has length, width and depth dimensions that correspond to the dimensions of the recess so that the housing will fit neatly and snugly within the recess but can be easily slid upwardly or downwardly of the recess when the header and jamb members 110, 120 and 122 and the tracks 160 are removed.

The housing 182 of the screen unit 180 (FIGS. 2, 6–8 and 12) is best described with reference to the header box 44 when the screen unit is assembled with the window frame 24. Assuming this assembled relationship, the housing has opposite end walls 184 against the opposite outer jamb pieces 70, an inside wall 186 against the inside panel 50, an outside wall 188 against the outside panel 46, a top wall against the top panel 48, and a bottom wall 192 resting on the top face of the header member 110. When assembled, therefore, the header member supports the screen unit within the recess 52. The bottom wall of the housing includes a horizontal slit 194 aligned with the gap 116 and thus the guideways 130 and the tracks 160 so that there is communication between the interior of the housing and the window opening 26. Stub tracks 196 project downwardly from the bottom wall of the housing in alignment with the slit at opposite ends thereof, as best seen in FIGS. 8–12, and spaced apart approximately the same distance as the main tracks in their assembled positions in the window frame. The inwardly projecting flanges 198 of the stub tracks are spaced closer together than the flanges 166 of the main tracks 160 so that the stub tracks will be telescopically received within the main tracks when the parts are assembled.

The screen unit 180 (FIGS. 2 and 12) also includes a roller 206 horizontally mounted within the housing 182 on an axle 208 that extends between and is mounted in the opposite end walls 184 of the housing. A flexible window screen 210 is wound about the roller and extends through the slit 194 and out of the housing, and a handle 212 is attached to the terminal edge of the screen outside of the housing. When the screen unit 180 is fitted in the recess 52 and the header and jamb members 110, 120, 122 and the tracks 160 are all assembled as above described, the opposite edges 214 and 216 of the screen and the handle, respectively, are slideably received in the stub and main tracks 196 and 160. In use, the screen is moveable by the handle between a fully retracted position and various selected screening positions. In its fully retracted position, most of the screen is wound about the roller but the terminus of the screen and the handle are located below the housing between the inside face of the header member 110 and the valance 58, as shown in FIG. 2. In this fully retracted position, the screen is thus obscured by the valance, as indicated in FIG. 1 wherein the screen is fully retracted and not visible. By pulling down on the handle the screen is moveable out of this retracted position into various screening positions within the window opening 26, two of such positions being shown in FIGS. 6 and 7. FIG. 6 shows the screen moved downwardly just a few inches from the top of the window opening, whereas FIG. 7 shows the screen in its fully closed or screening position covering the entire window. The screen unit includes a retracting mechanism, not shown, but well known, the enables the screen to be spring-urged upwardly into a fully retracted wound condition around the roller, as shown in FIGS. 1, 2 and 12, but allows the screen to be pulled down and maintained in selected positions, such as FIGS. 6 and 7.

DESCRIPTION OF THE METHOD OF THE USE

As previously described, one of the primary advantages of the subject window-screen combination 20 is concealment of the screen 210 when not in use for screening purposes while at the same time being easily accessible both for initial installation as well as for subsequent servicing or replacement. Moreover, it is to be kept in mind that the screen is ideal for use in a casement type window, although it is readily adaptable for use in other types of windows. The method of the present invention relates to the ease of installation or replacement, servicing, and removal of the screen unit 180 and is described at this point, with particular reference to FIGS. 8–11 which show the sequence of steps involved in installing and assembling the screen unit and the removable parts of the window frame. Removal and disassembly of the screen unit and removable frame parts involves performing these steps in reverse order.

With reference to FIG. 8, it is first noted that only the window frame 24 and screen unit 180 are shown, with the window 90 removed for illustrative convenience. Before assembly, therefore, the screen unit, the header member 110, the jamb members 120 and 122, and the tracks 160 are all separate from the fixed parts, as above described, of the window frame 24. It is to be noted that, although the window 90 itself is not shown in FIGS. 8–11, the installation or replacement, and removal, procedure to be described is typically performed with the window in place. In other words, the fact that the window is not shown in the FIGS. 8–11 does not mean that the screen installation may only be accomplished when the window is not in place. The screen installation and or removal can be effected irrespective of whether the window is installed, but a significant advantage of the invention is this procedure can be accomplished without removing the window.

Figure 9:
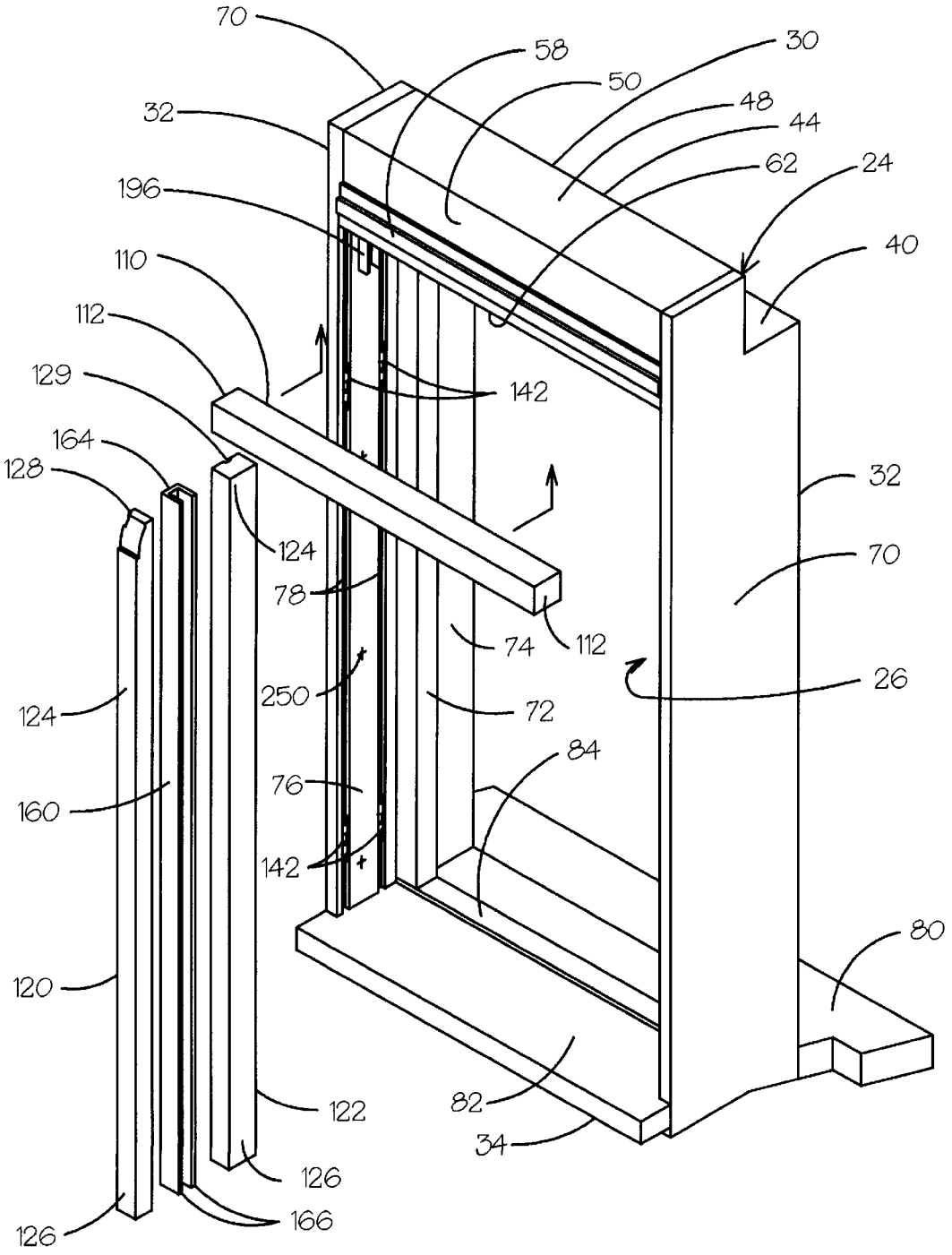

The first step (FIGS. 2 and 8) is to insert the screen unit 180 into the recess 52. Because of the dimensional relationships above described, the housing 182 fits between the outer jamb pieces 70, as illustrated in FIG. 8, from where it is aligned with and slidably upwardly fitted into the recess into the position shown in FIG. 2. Next, the header member 110 is moved between the outer jamb pieces 70, as illustrated in FIG. 9, and placed up against the bottom wall 192 of the screen housing 182. While holding the header member up against the screen housing with one hand, the assembler fastens the screws 114 through the intermediate header piece 42 into the header member. Now, the screen unit is supported in the recess by the header member, and the handle 212 and terminal portion of the screen 210 extend below the recess between the header member and the valance 58 with the screen and handle edges 214 and 216 in the stub tracks 196.

Figure 11:
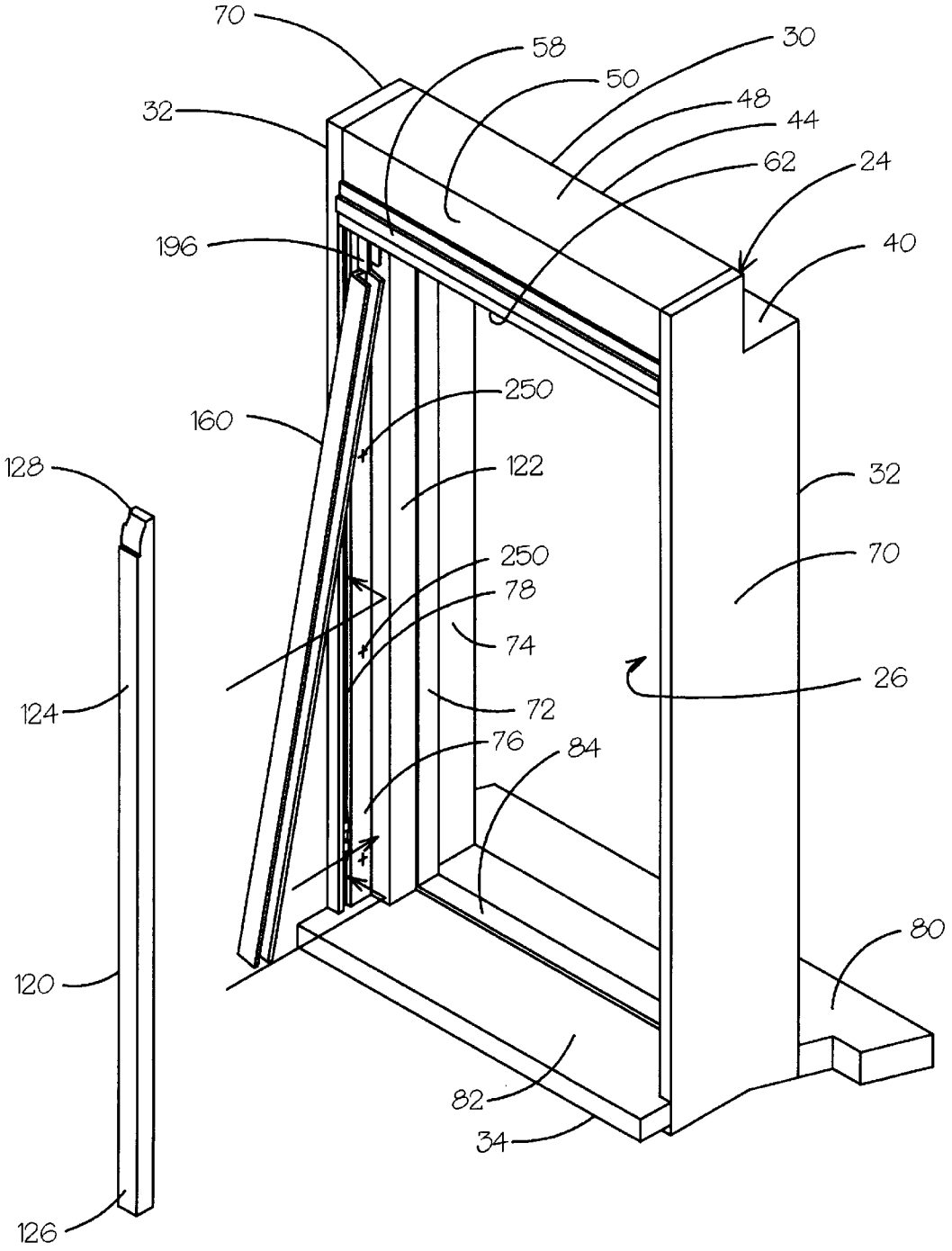

Next, as shown in FIGS. 10 and 11, the sets of jamb members 120 and 122 and the tracks 160 are installed. First, an outside jamb member 122 on one side of the window opening is placed over its respective slot 78, and the quick-connect fasteners 140 are engaged to fasten this outside jamb member in place. Then the main track 160 on that side of the window opening is inserted, telescopingly fitting the upper portion of the track over the corresponding stub track 196 and placing the outside flange 166 of the main track against the inside face of the outside jamb member 122 which is already in place. Screws 162 are then inserted in the holes provided therefor in the web 164 and screwed into the outer jamb piece 70 at the places marked by the crosshairs 250, thereby fastening, albeit removably, the main track to the outer jamb piece.

Continuing the installation or replacement procedure (FIGS. 10 and 11), the left inside jamb member 120 is next placed against the installed left main track 160 with the quick-connect fasteners 140 on the inside jamb member aligned so that these fasteners are interconnected thereby removably fastening the inside jamb member to the outer jamb piece, as shown in FIG. 3. The installation or replacement is completed by installing the jamb members 120 and 122 and the main track 160 on the opposite side, in this example the right side, of the window opening 26 in the same manner as just described with the first side of the window opening.

Having thus installed the screen unit 180 (FIG. 12), the edges 214 and 216 of the screen 210 and the handle 212 are aligned with the main tracks 160 since these parts are already in the stub tracks 196 which in turn are aligned with the main tracks because of their telescopically interfitted relationship. Thus, the screen is ready to be moved into the screening positions such as shown in FIGS. 6 and 7 from its retracted position as shown in FIGS. 1, 2 and 12.

As above noted, in order to remove the screen unit for servicing or replacement, the reverse procedure is followed (FIGS. 11, 10, 9 and 8). Simply k stated, the jamb members 120 and 122 and the tracks 160 are removed by releasing the quick-connect fasteners 140 and by removing the screws 162. The header member 110 is removed by unthreading the screws 114 whereupon the screen unit 160 will drop into the service person's hands. This entire procedure of installation or removal is accomplished very quickly and without disturbing the basic construction of the window-screen combination 20 and its installation in the building wall 22.

A very significant advantage of this window-screen combination 20 is the concealment of the screen unit 180 when not in use in a way which does not detract from the appearance of the window but in fact enhances it. That is, the subject invention is ideally suited for use with a wood window even though the screen unit 180 and the tracks 160 are of metal. As believed understood, the screen unit when not in use is concealed within the recess 52 and back of the valance 58, between the valance and the header member 110. The header member also conceals the screen unit since it covers the bottom wall 192 of the housing. Also, the tracks 160 are essentially concealed by the jamb members 120 and 122 between which they are sandwiched so that only the outer edges of the flanges 166 are visible. Even these edges are difficult to see from the normal vantage position in front of the window 90 when looking straight through the window instead of from one side or the other. Still further the brushes 170 in the tracks tend to mask the metal of the tracks and also obscure the quick-connect fasteners 140 from view. Accordingly, the over all wood appearance of the window is not compromised by an obtrusive showing of metal surfaces or projections.

Although a preferred embodiment of the present invention has been shown and described, various modifications, substitutions and equivalents may be used therein without departing from the spirit and scope of the invention. Accordingly, it is to be understood that the present invention has been described by way of illustration and not limitation.

What is claimed is:

1. A window-screen combination wherein the screen may be concealed when not in use but is readily accessible for use, servicing or replacement, comprising:

a window frame circumscribing a window opening and including a peripheral outer frame portion providing an elongated recess facing into the opening, the frame also including a plurality of elongated inner frame members separable from the outer frame portion and disposed along the periphery of the opening, a first of the frame members positioned over the recess so that a passageway remains between the recess and the opening, other of the frame members extending from the first frame member and forming opposed guideways adjacent to the window opening and aligned with the passageway, said first frame member being releasably attached to the outer frame portion;

quick-connect fasteners located between the outer frame portion and said other frame members and releasably interconnecting the other frame members to the outer frame portion; and a screen unit removably received in the recess and being retained therein by the first frame member, the screen unit including a screen aligned with the passageway, the screen being movable through the passageway and within the guideways into screening positions in the window opening and a retracted position out of the opening.

2. The window-screen combination of claim 1, wherein there are tracks removably attached to the outer frame portion in the guideways.

3. The window-screen combination of claim 1, wherein there are main tracks removably attached to the outer frame portion in the guideways; and wherein there are stub tracks projecting from the screen unit and releasably interfitting with the main tracks.

4. A window-screen combination for use in the wall of a building wherein the screen may be concealed when not in use but is readily accessible for use, servicing or replacement, comprising:

a window frame circumscribing a window opening and including a peripheral outer frame portion providing an elongated recess facing into the window opening, the recess having opposite ends, the frame also including a plurality of elongated inner frame members located along the periphery of the window opening and separable from the outer frame portion, one of the frame members partially covering the recess and defining a gap with the outer frame portion, said gap providing a passageway between the recess and the window opening, a set of other frame members extending from each end of the recess in spaced relation to each other thereby forming opposed guideways that face into the window opening and are aligned with the gap;

a first fastener releasably attaching said one frame member to the outer portion;

second fasteners of the quick-connect type located between the outer frame portion and said other frame members and releasably attaching said other frame members to the outer portion, said fasteners being obscured by the outer frame portion and the frame members;

tracks positioned in the guideways in alignment with the gap; and a screen unit slidably, removably fitted in the recess and being supported therein by said one frame member, the screen unit including a screen aligned with the tracks and having opposite side edges in the tracks, the screen being movable through the gap into screening positions in the window opening with the side edges moving along and being guided by the tracks and a retracted position out of the opening.

5. The window-screen combination of claim 4, wherein each quick-connect fastener includes a male part on one of the side frame members and the outer frame portion and a female part on the other of the side frame members and the outer frame portion, the respective male and female parts being releasable interfitted in the interconnected condition of the fastener, and spring-urged latches yieldably retaining corresponding male and female parts in interconnected condition.

6. The window-screen combination of claim 4, wherein the tracks are main tracks;

wherein the screen unit has stub tracks projecting therefrom; and wherein the stub tracks releasably interfit with the main tracks.

7. The window-screen combination of claim 4, wherein the recess is slightly larger than the screen unit and the screen is freely slidable fitted into and out of the recess when said one frame member is removed.

8. The window-screen combination of claim 4, wherein the frame is wood and tracks are metal; and wherein the tracks are closely sandwiched between their respective sets of said other frame members and project slightly outwardly therefrom.

9. The window-screen combination of claim 4, wherein the frame is wood and screen unit is metal; and wherein the screen unit includes a handle connected to the screen, the handle and adjacent segment of the screen projecting out of the gap when the screen is fully retracted.

10. The window-screen combination of claim 4, wherein the frame is wood and tracks and screen unit are metal;

wherein the tracks are closely sandwiched between their respective pairs of said other frame members and project slightly outwardly therefrom; and wherein the screen unit includes a handle connected to the screen, the handle and adjacent segment of the screen projecting out of the gap when the screen is fully retracted.

11. A window-screen combination for use in the wall of a building wherein the screen may be concealed when not in use but is readily accessible for use, servicing or replacement, comprising:

a window frame circumscribing a window opening and including a peripheral outer frame portion having a head providing an elongated recess facing into the window opening, the recess having opposite ends, the outer frame portion having opposed jambs adjacent to the opening, the window frame also including elongated header and jamb members respectively located along the head and jambs of the outer frame portion, adjacent to the window opening, and being separable from the outer frame portion, the header member partially covering the recess and defining a gap with the outer frame portion, said gap providing a passageway between the recess and the window opening, there being a pair of jamb members extending from each end of the recess in spaced relation to each other thereby forming opposed guideways that face into the window opening and are aligned with the gap;

tracks individually sandwiched between the pairs of jamb members and extending along the jambs of the outer frame portion within the guideways in alignment with the gap;

first threadable fasteners attaching said header member to the outer frame portion;

quick-connect fasteners located between the outer frame portion and each of said jamb members and releasably attaching said jamb members to the outer portion, said fasteners being obscured by the outer frame portion and the jamb members;

second threadable fasteners attaching the tracks to the outer frame portion; and a screen unit slidably, removably fitted in the recess and being supported therein by the header member, the screen unit including a screen aligned with the tracks and having opposite side edges in the tracks, the screen being movable through the passageway from a retracted position out of the opening into screening positions in the window opening with the side edges moving along and being guided by the tracks.

12. The window-screen combination of claim 11, wherein each quick-connect fastener includes a male part on one of the jamb and outer frame portion and a female part on the other of the jamb and outer frame portion, the respective male and female parts being releasable interfitted in the interconnected condition of the fastener, and spring-urged latches yieldably retaining corresponding male and female parts in interconnected condition.

13. The window-screen combination of claim 11, wherein the tracks are main tracks;

wherein the screen unit has stub tracks projecting therefrom; and wherein the stub tracks releasably interfit with the main tracks.

14. The window-screen combination of claim 11, wherein the recess is rectangular having a predetermined length, width and depth;

wherein the screen unit is rectangular and has a length, width and depth just slightly less than the recess whereby the screen is slidable movably fitted in the recess when the header member is removed;

wherein the header member is of substantially the same length as the screen unit and of a depth less than the depth of the recess and screen unit thereby providing said gap; and wherein a valance is attached to the frame in opposed spaced relation to the header member and on the opposite side of the screen from the header member.

15. A method of installing a screen unit in a window frame wherein the window frame circumscribes a window opening and includes a peripheral outer frame portion providing an elongated recess facing into the opening, the frame also including a plurality of elongated frame members separable from the outer frame portion and from the screen unit and from each other and positionable along the periphery of the opening, the screen unit including a screen capable of moving between screening positions in the window opening and retracted position out of the opening, comprising the steps of:

slidably fitting the screen unit in the recess while remaining separated from the frame members, installing a first of the frame members in the frame portion in supporting and concealing relation to the screen unit, and releasably maintaining the first frame member in said supporting and concealing relation by others of the frame members.

16. The method of claim 15, including the steps of:

releasably attaching said first frame member to the outer frame portion over the recess so that a passageway remains between the recess and the opening; and releasably attaching said other frame members to the outer frame portion with quick-connect fasteners located between the outer frame portion said other frame members with said fasteners being obscured by the outer frame portion and the framing members and thus being invisible exteriorly of the window when so interconnected.

17. The method of claim 16, including the steps of:

fastening said other of the frame members in positions extending from the first frame member and forming opposed guideways adjacent to the window opening aligned with the passageway, and positioning the screen in the guideways and thereby guiding the screen in its movement into and out of screening positions.

18. The method of claim 15, including the steps of:

fastening the first frame member to the outer frame portion by screw fasteners, fastening the other frame members to both sides of the outer frame portion by quick-connect fasteners that are concealed between the other frame members and the outer frame portion and so as to provide guideways at opposite sides of the window, sandwiching screen tracks in the guideways, fastening the tracks to the outer frame portion by screws, concealing the screws inside the tracks, and guiding opposite edges of the screen from the screen unit into the tracks.

19. The method of claim 15, including the steps of:

installing fasteners on the frame portion, and attaching the others of the frame members to the frame portion by the fasteners and in concealing relation to the fasteners.

20. The method of claim 15, including the steps of:

installing the first of the frame members in substantially parallel relation to the screen unit, and installing the others of the frame members in substantially perpendicular relation to the screen unit and the first frame member.

* * * * *